US008171909B2

(12) United States Patent
Brusutti

(10) Patent No.: US 8,171,909 B2
(45) Date of Patent: May 8, 2012

(54) INTERNAL COMBUSTION ENGINE

(76) Inventor: Giancarlo Brusutti, Mogliano Veneto (IT)

( * ) Notice: Subject to any disclaimer, the term of this patent is extended or adjusted under 35 U.S.C. 154(b) by 376 days.

(21) Appl. No.: 12/311,368

(22) PCT Filed: Sep. 27, 2007

(86) PCT No.: PCT/EP2007/060248

§ 371 (c)(1),
(2), (4) Date: Mar. 27, 2009

(87) PCT Pub. No.: WO2008/040673

PCT Pub. Date: Apr. 10, 2008

(65) Prior Publication Data

US 2010/0018492 A1 Jan. 28, 2010

(30) Foreign Application Priority Data

Oct. 5, 2006 (IT) ..... PD2006A0366

(51) Int. Cl.
*F01L 7/00* (2006.01)

(52) U.S. Cl. ..... 123/190.4; 123/80 D; 123/190.17; 123/657

(58) Field of Classification Search .... 123/80 R–80 DA, 123/81 R–81 D, 190.1, 190.12, 190.13, 190.4–190.9, 123/190.17, 657, 664–666
See application file for complete search history.

(56) References Cited

U.S. PATENT DOCUMENTS

| | | | |
|---|---|---|---|
| 2,048,134 | A | 7/1936 | Montalto |
| 4,976,232 | A | 12/1990 | Coates |
| 5,626,107 | A | 5/1997 | De Blasi |

FOREIGN PATENT DOCUMENTS

| | | | |
|---|---|---|---|
| DE | 886 403 | C | 8/1953 |
| EP | 0 117 993 | A | 9/1984 |
| IT | 1 172 733 | B | 6/1987 |

*Primary Examiner* — Noah Kamen
(74) *Attorney, Agent, or Firm* — Modiano & Associati; Albert Josif; Daniel O'Byrne

(57) ABSTRACT

An internal combustion engine of the two- or four-stroke petrol, diesel or gas-fueled type, comprising: an engine block which forms internally at least one cylinder; a head which contains a cylindrical rotary distributor which is adapted to connect, by means of two internal ports, a combustion chamber of the at least one cylinder alternately to the air intake and to the gas exhaust; a plate for closing the head in an upper region, in which intake and exhaust conveyance channels of the engine are provided; for each at least one cylinder being provided a single sealing element which is arranged between the at least one cylinder and the rotary distributor. The sealing element has a cradle which is shaped complementarily with respect to the rotary distributor and a cylindrical protrusion that has an open cavity which forms the combustion chamber of the cylinder. The sealing element has a port for connection between the combustion chamber and the two internal ports of the rotary distributor which is formed through the cradle. The upper closure plate of the head has a portion, which is inserted between the walls of the head, which faces and is substantially shaped complementarily with respect to the rotary distributor.

13 Claims, 4 Drawing Sheets

INTERNAL COMBUSTION ENGINE

The present invention relates to an internal combustion engine of the type with rotary distributor.

BACKGROUND OF THE INVENTION

As is known, the distribution elements of an internal combustion engine (or more simply the distribution) are located on the head of the motor and allow to open and close alternately the intake and exhaust ports of the combustion chamber.

The most widespread type of distribution is constituted by camshafts, rods and rockers, which actuate mushroom valves which are adapted to open and close alternately the intake and exhaust ports of the combustion chamber.

Another type of distribution is also known which is termed rotary and has a distribution element constituted by a cylindrical rotor, which is connected kinematically to the engine shaft, rotates synchronously therewith and alternately closes and opens the ports for connecting the cylinders to the intake and exhaust conveyance channels.

A distribution of this type is disclosed in Italian patent No. 1172733 filed on Feb. 3, 1983 by this same applicant.

In this distribution, the cylindrical rotor (also known as rotary cylindrical distributor) is tubular and is divided, by means of dividing partitions, into substantially cylindrical internal chambers, two for each cylinder, each provided with at least two ports.

The head of the engine is constituted by a box-like body, which is arranged above the cylinders of the engine; the cylindrical distributor is arranged inside said body.

The box-like body is provided with side walls, a lower closure plate and an upper closure plate.

The plates and the walls are rigidly coupled by means of study bolts which pass through them and on related fixing portions provided on the upper part of the engine block on which the cylinders are provided.

There are also mutually opposite upper and lower sealing elements, two for each cylinder, which slide on the cylindrical distributor.

In particular, such sealing elements are provided with a cradle which is shaped complementarily with respect to the cylindrical distributor and a protrusion which protrudes from the cradle and is inserted in a respective through seat which is formed on the corresponding upper or lower plate.

A through hole is provided through the protrusion and the cradle and connects, if referred to the upper sealing element, the respective internal chamber of the rotary cylindrical distributor to the intake or exhaust conveyance channel, and, if referred to the lower sealing element, the respective internal chamber of the rotary cylindrical distributor with the combustion chamber of the cylinder (the internal chambers are therefore ports connecting the combustion chamber and the intake/exhaust).

Such sealing elements are accommodated with play (on the order of a few tenths of a millimeter) in such a way that it is possible to compensate the thermal deformations of the rotary cylindrical distributor and avoid its seizure.

In particular, the lower sealing element, once combustion has occurred inside the combustion chamber, tends to compensate the play, since it is pushed by the pressure of the combustion so as to form a seal against the rotary cylindrical distributor.

Although this type of distribution is known and has now been appreciated for many years, it is not free from aspects which can be improved, in particular in relation to the number of components that are present and to the compactness of the structure.

SUMMARY OF THE INVENTION

The aim of the present invention is to provide an internal combustion engine which has a rotary distributor which is improved in terms of compactness and functionality.

Within this aim, an object of the present invention is to provide an internal combustion engine with rotary distributor which can be industrialized at a lower cost than engines with similar rotary distributors.

Another object of the present invention is to provide an internal combustion engine with rotary distributor which has a particularly high performance and is particularly reliable.

This aim and these and other objects, which will become better apparent hereinafter, are achieved by an internal combustion engine, which comprises

- an engine block which forms internally at least one cylinder,
- a head which contains a cylindrical rotary distributor which is adapted to connect, by means of at least two internal ports which are substantially transverse to the axis of said cylindrical rotary distributor, a combustion chamber of said at least one cylinder alternately to the air intake and to the gas exhaust,
- a plate for closing said head in an upper region, in which the intake and exhaust conveyance channels of the engine are provided, characterized in that it comprises, for each at least one cylinder, a single sealing element which is arranged between said at least one cylinder and said rotary distributor, said sealing element having a cradle which is shaped complementarily with respect to said rotary distributor and a cylindrical protrusion which is substantially shaped complementarily with respect to the upper portion of the sleeve of the corresponding said at least one cylinder, said protrusion having an open cavity which forms the combustion chamber of said cylinder, said cradle being adapted to adhere against said rotary distributor during the compression and combustion steps of the combustible fluid in said combustion chamber, said sealing element having at least one port for connection between said combustion chamber and said at least two internal ports of said rotary distributor which is formed through said cradle, said upper closure plate of said head having a portion, which is inserted between the walls of said head, which faces and is substantially shaped complementarily with respect to said rotary distributor.

Advantageously, the head with said cylindrical rotary distributor, said upper closure plate and said at least one sealing element constitute a kit for replacing heads of engines with distributions of a different type.

BRIEF DESCRIPTION OF THE DRAWINGS

Further characteristics and advantages of the invention will become better apparent from the following detailed description of a preferred but not exclusive embodiment thereof, illustrated by way of non-limiting example in the accompanying drawings, wherein.

DESCRIPTION OF THE PREFERRED EMBODIMENTS

Figure 1:
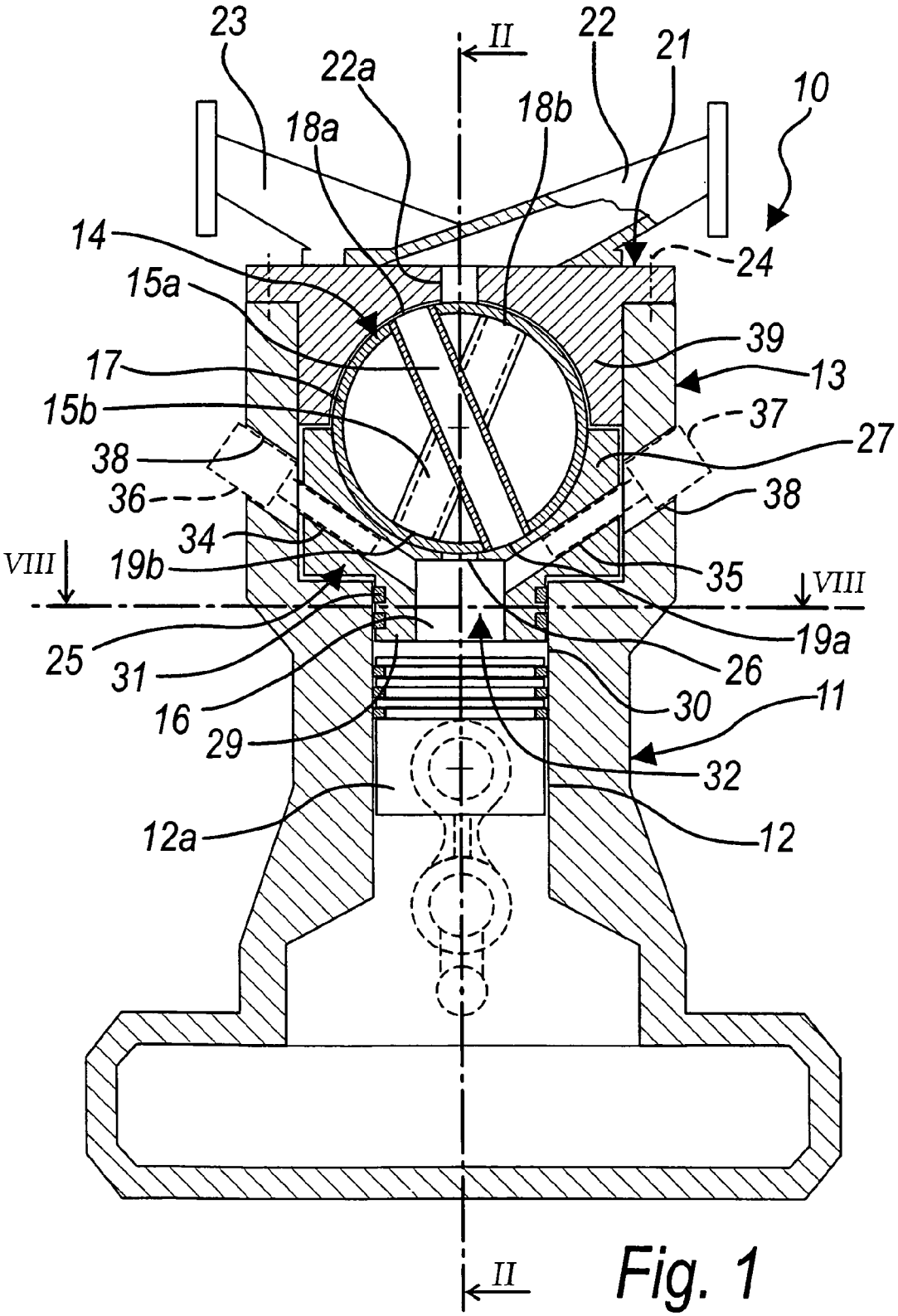
FIG. 1 is a schematic sectional front view, taken along the line I-I of FIG. 2, of an engine according to the invention, in the initial step of induction.
Figure 2:
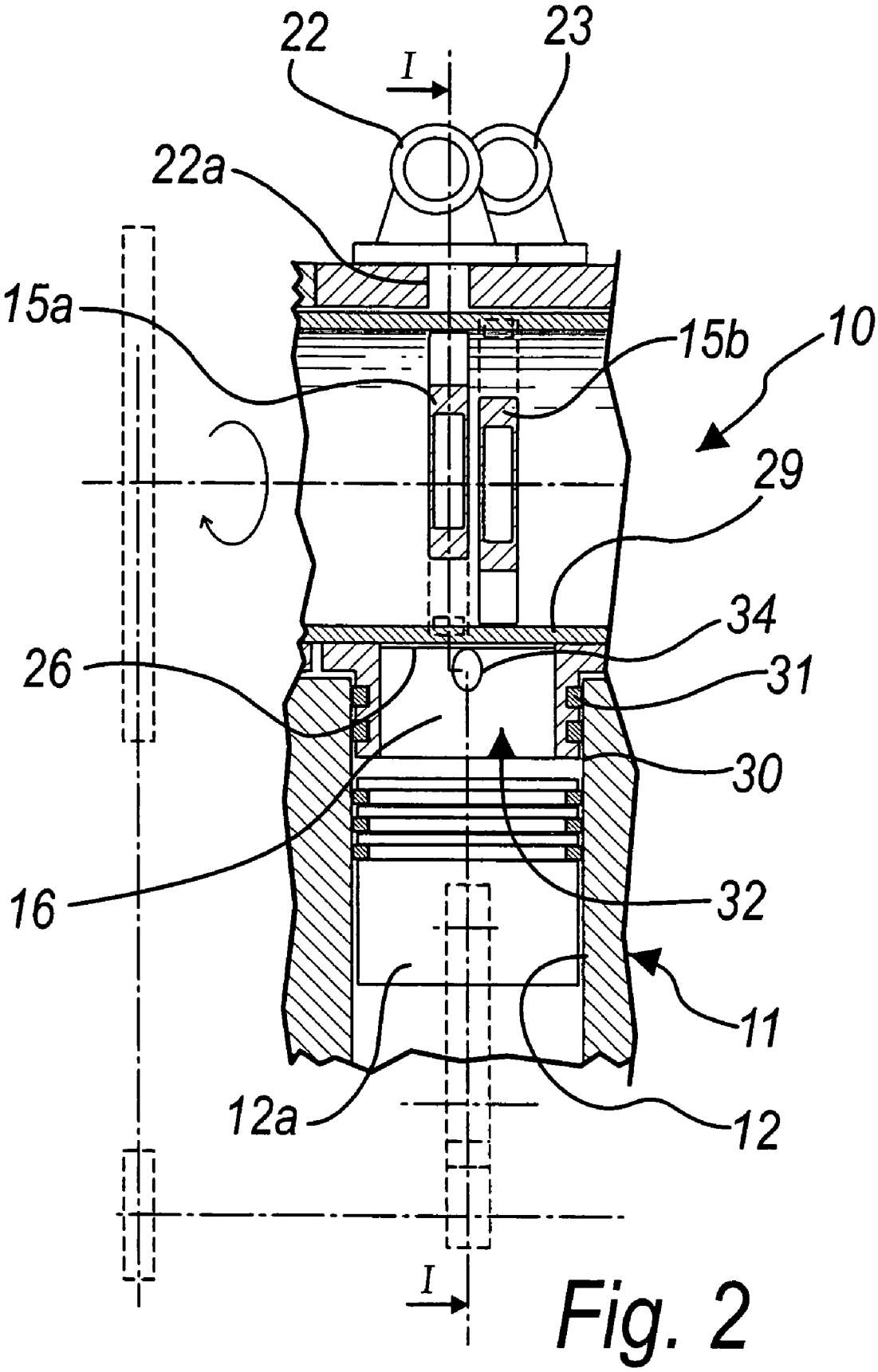
FIG. 2 is a sectional schematic side view, taken along the line II-II of FIG. 1, of a portion of the engine according to the invention.

It is noted that anything found to be already known during the patenting process is understood not to be claimed and to be the subject of a disclaimer.

With reference to the figures, an internal combustion engine according to the invention is generally designated by the reference numeral 10.

In this description, the engine is for example of the four-stroke air-cooled or water-cooled gasoline type, but the invention can be applied equivalently to any type of four-stroke or two-stroke internal combustion engine, of the gasoline-, diesel- or gas-fueled type.

The engine 10 comprises an engine block 11 which forms internally a plurality of cylinders 12 (the engine can be of the single- or multi-cylinder type).

A head 13 of the engine is located above the region of the engine block 11 that is occupied by the cylinders 12.

The head 13 is provided monolithically with the engine block 11 so as to provide in practice a monobloc element.

The head 13 contains a rotary distributor 14, which according to the background art connects, by means of respective ports 15*a* and 15*b*, a combustion chamber 16 of the cylinders 12 alternately to the air intake and to the gas exhaust.

In particular, the rotary distributor 14 comprises a cylindrical tubular element 17, on the cylindrical surface of which there are, for each cylinder 12, two pairs of through openings 18 and 19; the openings of each pair (18*a*, 19*a* or 18*b*, 19*b*) are angularly offset by 180° with respect to the axis of the cylindrical tubular element 17.

The ports 15*a* and 15*b* are constituted by respective tubular ducts (which hereinafter will take the same numbering for the sake of simplicity), which are arranged transversely to the axis of the cylindrical tubular element 17 and each ends at the openings a or b of a corresponding pair (18, 19).

The two tubular ducts 15*a* and 15*b* (and therefore the corresponding openings) are mutually angularly offset with respect to the axis of the cylindrical tubular element 17 and are spaced along the same axis so as to not intersect each other; in this example, said ducts are offset by 22.5°.

The first tubular duct 15*a* corresponds to the air intake in the combustion chamber, while the second duct 15*b* corresponds to the gas exhaust (as shown in the figures, since the piston 20 is at the top dead center).

It is evident that the number of ducts (and of corresponding openings) for each cylinder can vary from two to more than two, and in practice the number of ducts and their angular offset, given a certain rotation rate, constitute the parameters that constitute the intake and exhaust frequency of the cylinders.

The transverse cross-section of the tubular ducts is for example quadrangular, but other shapes may be used conveniently.

The head 13 is closed by an upper closure plate 21; intake conveyance channel 22 and exhaust conveyance channel 23 of the engine are fixed to the upper closure plate 21.

The upper closure plate 21 is, for example, fixed to the walls of the monobloc constituted by the head 13 and the engine block 11 by means of stud bolts designated schematically by the reference numeral 24.

Two through holes for each cylinder are provided in the upper closure plate 21 (only one through hole 22*a* is shown in the figures) and allow connection between the intake conveyance channel 22, the exhaust conveyance channel 23 and the ducts 15.

A corresponding compression-type sealing element 25 is provided between each cylinder 12 and the rotary distributor 14 and is shaped complementary with respect to the rotary distributor 14.

In this embodiment, the sealing element 25 has a single port 26 for connection between the combustion chamber 16 and the ducts 15*a* and 15*b* of the rotary distributor 14 (one for each duct 15); of course, the area of the port 26 has such dimensions as to allow the overlap of both pairs of openings 18 of the ducts 15*a* and 15*b*.

The sealing element 25 is provided with a cradle 27 which has an upper surface 28 which faces the rotary distributor 14 and is shaped complementary thereto, and a protrusion 29 which protrudes below the cradle 27.

The protrusion 29 is substantially cylindrical and shaped complementary with respect to an upper portion 30 of the sleeve of the corresponding cylinder and is inserted therein; the protrusion 29 is provided laterally with angular seats 31 for corresponding sealing rings.

The protrusion 29 is provided in a lower region with a cavity 32 which is open toward the cylinder 12 and forms substantially the combustion chamber 16.

The cavity 32 is provided with a top in which the port 26 is provided for connection between the combustion chamber 16 and the tubular ducts 15*a*, 15*b* of the rotary distributor 14.

In the preferred embodiment, the outside diameter of the rotary distributor 14 is substantially equal to the value of the diameter of the cylinder 12 plus the value of half of said diameter of the cylinder 12; other size ratios between the diameter of the distributor and the diameter of the cylinder are in any case possible depending on the structural and performance requirements to be achieved (for example, it is possible to provide rotary distributors with a smaller diameter than the one being described).

Figure 8:
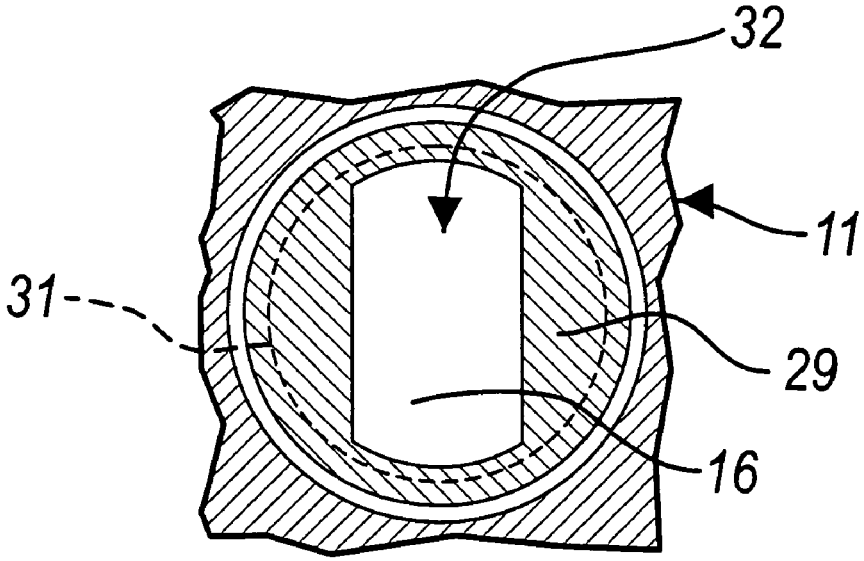
FIG. 8 is a sectional plan view, taken along the line VIII-VIII of FIG. 1.
Figure 4:
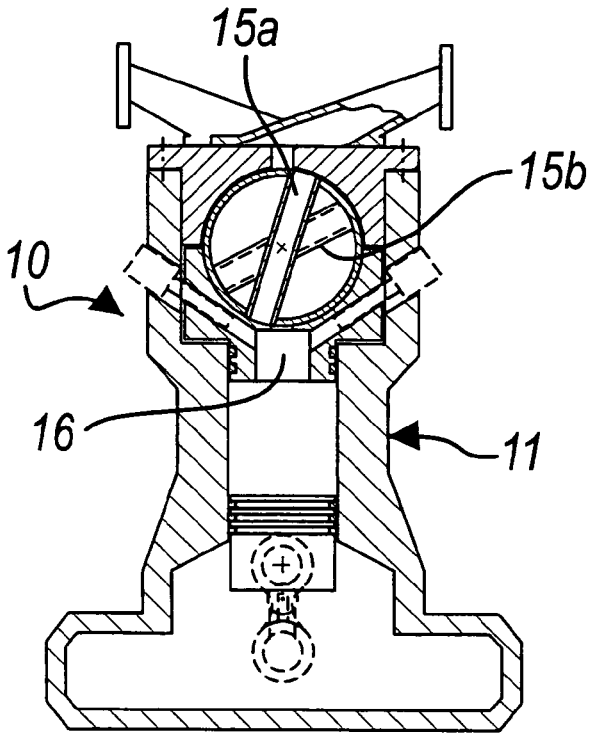
FIG. 4 is a sectional schematic front view, taken along the line I-I of FIG. 2, of an engine according to the invention in the final step of induction.

Advantageously, an optimum value of the ratio between the area of the port 26 of the sealing element 25 and the area of the surface of the protrusion 29 on which the pressure generated by the combustion of the combustible fluid acts (which correspond substantially to the circular area of the cross-section of the protrusion 29 minus the area of the port 26, as shown in the cross-section of FIG. 8) has been determined.

In particular, the area of the port 26 is substantially equal to one third of said area on which the pressure generated by combustion acts.

With this ratio, the sealing element 25, during the combustible fluid compression and combustion strokes, adheres to the rotary distributor so as to provide the seal, without pushing against it or pushing to a negligible extent without causing contact friction.

A first through receptacle 34 and a second through receptacle 35 are provided on the sides of the sealing element 25 and both end in the upper part of the combustion chamber 16 (the cavity 32).

Means for the direct injection of fuel 36, such as a fuel injector of a known type, shown schematically in FIG. 1 in dashed lines, are arranged in the first through receptacle 34, while means for igniting the combustion mix 37, such as a spark plug, are arranged within the second through receptacle 35.

Additional through holes 38 are provided on the outer walls of the head 13 at the through receptacles 34 and 35, are wider than the through receptacles 34 and 35 and allow to insert therein said direct fuel injection means 36 and means for igniting the combustion mix 37.

The upper closure plate 21 of the head 13 in which the intake conveyance channel 22 and the exhaust conveyance channel 23 are formed has a portion 39 which is inserted between the walls of the head 13, is shaped substantially complementary to the rotary distributor and faces it.

Constructively, the receptacle of the sealing element 25 between the rotary distributor 14 and the head 13 has play, in order to allow compensation of the thermal expansions of said distributor which would lead to seizure of the engine (FIG. 1 shows in an augmented manner the gap around the sealing element 25).

Play is provided also between the lower portion 38 of the upper closure plate 21 to allow compensation of the thermal expansions of the rotary distributor 14 (in this case also, said play is shown in an augmented manner in FIG. 1).

Engine cooling means (not shown) are further provided and are adapted to circulate a cooling fluid, such as air or water in this embodiment, within the rotary distributor 14, so as to strike the tubular ducts 15*a* and 15*b*.

The operation of the engine is as follows.

With reference to FIG. 1, the initial step of induction is shown.

Figure 3:
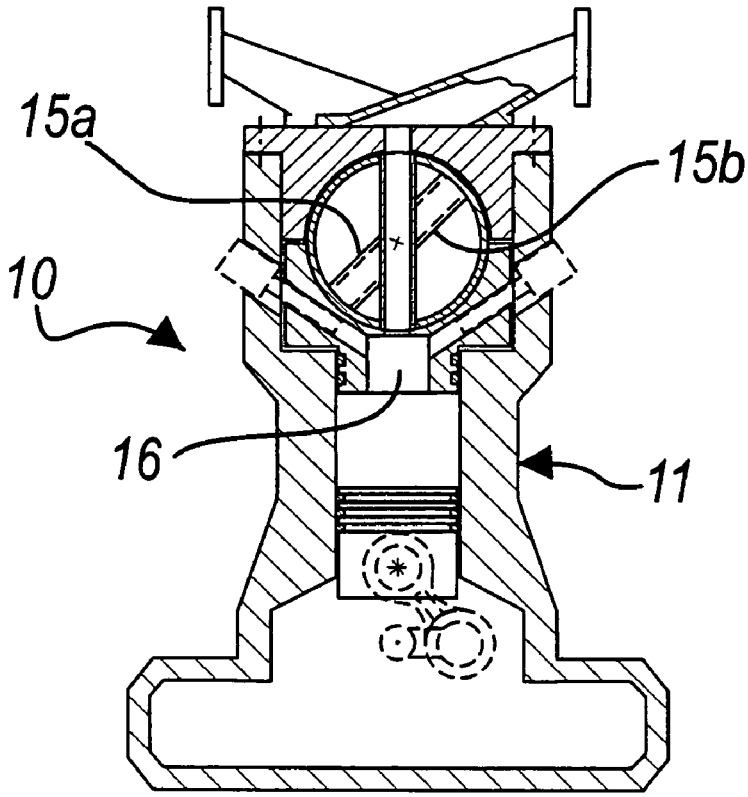
FIG. 3 is a sectional schematic front view, taken along the line I-I of FIG. 2, of an engine according to the invention in the mid-induction step.

The rotary distributor turns until the intake duct 15*a* faces the port 26 of the combustion chamber (the exhaust duct, which is offset by 22.5°, is closed between the surfaces of the sealing element and of the upper plate); in FIG. 3, said duct faces the port completely. In this step, the piston performs a translational motion to the bottom dead center to provide the induction stroke.

Figure 5:
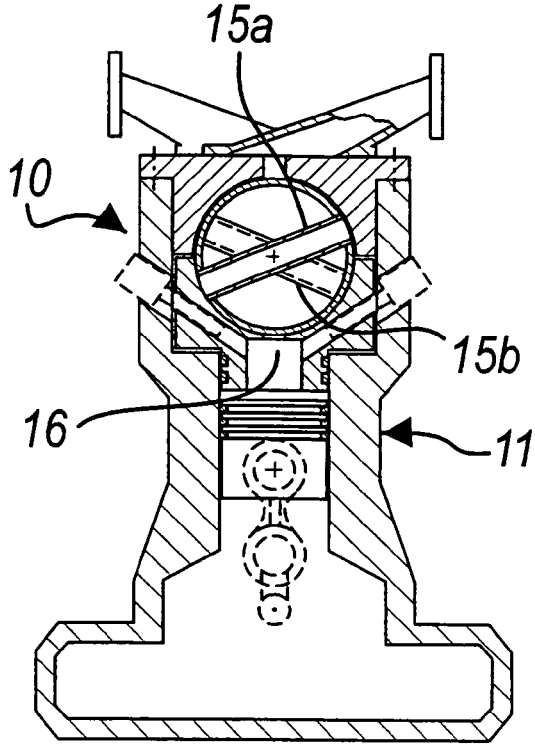
FIG. 5 is a sectional schematic front view, taken along the line I-I of FIG. 2, of an engine according to the invention in the compression and combustion step.

Continuing the rotation of the distributor, the intake duct closes on the surfaces of the sealing element and of the upper plate, and so does the exhaust duct: the combustion chamber is therefore isolated and it is possible to provide the compression and combustion step (in FIG. 5, the piston has performed a translational motion to the top dead center).

Figure 6:
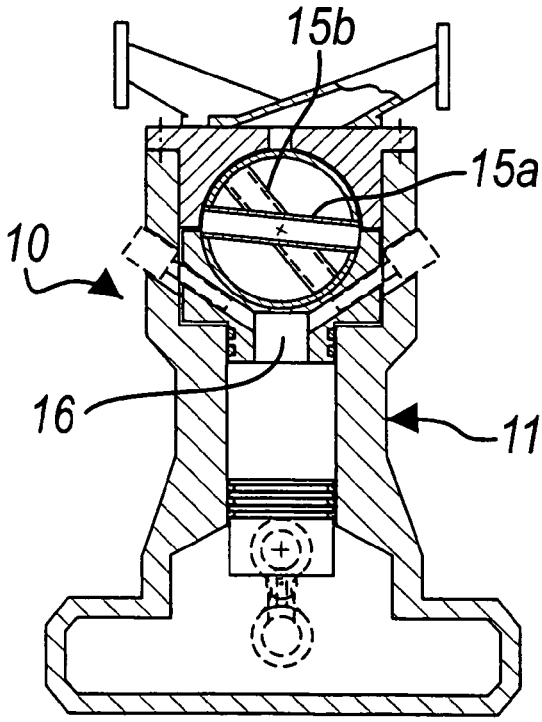
FIG. 6 is a sectional schematic front view, taken along the line I-I of FIG. 2, of an engine according to the invention in the final expansion step.

During the subsequent expansion stroke (FIG. 6), the distributor continues to rotate, keeping the combustion chamber isolated and moving the exhaust duct proximate to the port 26 of the combustion chamber (piston toward the bottom dead center).

Figure 7:
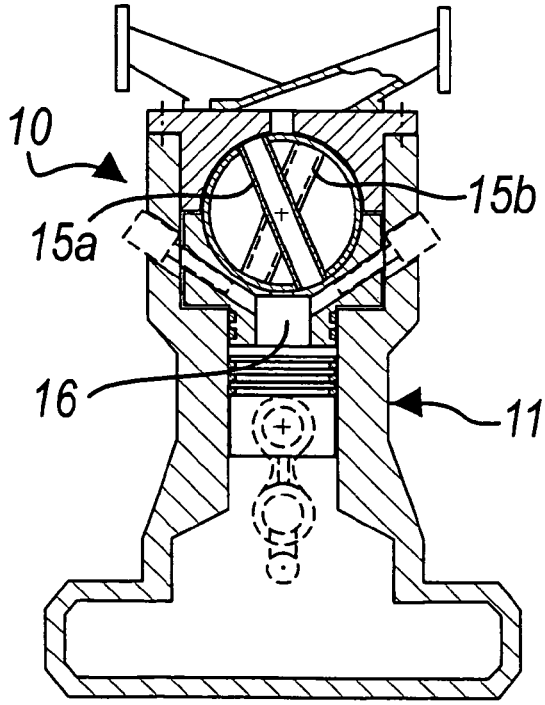
FIG. 7 is a sectional schematic front view, taken along the line I-I of FIG. 2, of an engine according to the invention in the final exhaust step.

A further rotation of the distributor opens the exhaust duct onto the combustion chamber, thus performing the gas exhaust stroke (FIG. 7).

In practice it has been found that the invention thus described achieves the intended aim and objects.

The present invention has in fact provided an internal combustion engine of the type with rotary distributor and direct injection which is particularly compact.

The upper sealing element in the upper closure plate has in fact been eliminated, in practice leaving only a single component, i.e., the lower sealing element, with the burden of adapting itself to the rotary distributor.

Moreover, the overall height of the engine has been reduced, since with respect to known configurations the height of the head has been lowered as a whole, by eliminating the lower closure plate thereof.

Moreover, the provision of the upper part of the combustion chamber in the protrusion of the sealing element has allowed to reduce further the height of the engine, since the volume of the combustion chamber is divided between the cylinder and the protrusion of the sealing element, while in known configurations it was formed substantially entirely below the protrusion.

The use of means for direct injection of fuel into the combustion chamber allows to reduce further the overall height of the engine, since the injection means are no longer arranged above the head in order to inject through the rotary distributor but are arranged laterally within the sealing element.

Moreover, the use of a rotary distributor of this type allows to eliminate the counterweights of the engine shaft which are typically present in engines with a cam distribution of the traditional type.

This allows to reduce further the center distance between the engine shaft and the rotary distributor shaft (the counterweights have a space occupation which is thus eliminated).

Moreover, the elimination of the counterweights allows faster acceleration, since the engine shaft has a smaller mass.

The use of tubular ducts to provide the connecting ports of the rotary distributor instead of the old cylindrical chambers allows to achieve optimum cooling of the rotary distributor, since it can be crossed by the cooling fluid, something which is not possible when the connecting ports between the combustion chamber and the intake and exhaust conveyance channels are constituted by partitions.

Moreover, such ducts allow to convey more efficiently the intake and exhaust flows, avoiding turbulences proximate to the openings of said ducts, particularly when the exhaust gases pass between the duct and the conveyance channel.

The provision of a monobloc unit between the head and the engine block further reduces the number of components and therefore the assembly types of the engine, reducing manufacturing costs.

In any case it is evident that many of the advantages mentioned above can also be provided with a structure which is not a monobloc unit, i.e., with a head which is separate from the engine block but is joined to it by way of traditional fixing systems.

For example, it is possible to provide a kit for replacing, in engines of the traditional type, the head having a distribution of the type with a camshaft which actuates valves with a head which supports a distribution of the type according to the invention.

This kit can comprise therefore a lower plate, to be arranged above the cylinders, which is provided with openings for the insertion of corresponding sealing elements according to the invention.

An internally hollow box-like body can be arranged over said plate for the insertion of the rotary distributor and is open in a lower region to allow interaction between the sealing elements and the surface of the distributor.

In an upper region there is a closure plate on which the intake and exhaust conveyance channels are provided, said plate being shaped complementarily with respect to the rotary distributor, according to the invention.

The plates and the box-like body can be fixed to the engine block for example by means of through stud bolts.

The invention thus conceived is susceptible of numerous modifications and variations, all of which are within the scope of the appended claims; all the details may further be replaced with other technically equivalent elements.

In practice, the materials employed, so long as they are compatible with the specific use, as well as the dimensions, may be any according to requirements and to the state of the art.

The disclosures in Italian Patent Application No. PD2006A000366 from which this application claims priority are incorporated herein by reference.

What is claimed is:

1. An internal combustion engine, comprising an engine block which forms internally at least one cylinder, a head which contains a cylindrical rotary distributor which is adapted to connect, by means of at least two internal ports which are substantially transverse to the axis of said cylindrical rotary distributor, a combustion chamber of said at least one cylinder alternately to the air intake and to the gas exhaust, a plate for closing said head in an upper region, in which intake and exhaust conveyance channels of the engine are provided, further comprising, for each at least one cylinder, a single sealing element which is arranged between said at least one cylinder and said rotary distributor, said sealing element having a cradle which is shaped complementarily with respect to said rotary distributor and a cylindrical protrusion which is substantially shaped complementarily with respect to the upper portion of the sleeve of the corresponding said at least one cylinder, said protrusion having an open cavity which forms the combustion chamber of said cylinder, said cradle being adapted to adhere against said rotary distributor during the compression and combustion steps of the combustible fluid in said combustion chamber, said sealing element having at least one port for connection between said combustion chamber and said at least two internal ports of said rotary distributor which is formed through said cradle, said upper closure plate of said head having a portion, which is inserted between the walls of said head, which faces and is substantially shaped complementarily with respect to said rotary distributor.

2. The internal combustion engine according to claim 1, wherein said cavity is provided with a top in which there is said at least one port for connection between said combustion chamber and said at least two internal ports of said rotary distributor.

3. The internal combustion engine according to claim 1, further comprising on a side of said sealing element, at least one through receptacle which accommodates means for igniting a combustion mix.

4. The internal combustion engine according to claim 1, further comprising on a side of said sealing element, at least one through receptacle for means for direct injection of fuel.

5. The internal combustion engine according to claim 1, further comprising at least one first through receptacle, which accommodates a corresponding fuel injector and at least one second through receptacle, which accommodates means for igniting a combustion mix.

6. The internal combustion engine according to claim 5, wherein on outer walls of said head, at said through receptacles, there are additional through holes which are wider than said through receptacles.

7. The internal combustion engine according to claim 1, wherein said at least two internal ports are constituted by respective tubular ducts.

8. The internal combustion engine according to claim 7, wherein said rotary distributor comprises a cylindrical tubular element, on the cylindrical surface of which there are at least two pairs of through openings, said openings of each pair being angularly mutually offset by 180° with respect to the axis of the cylindrical tubular element, at least two of said tubular ducts arranged transversely to the axis of said cylindrical tubular element and each ending at the openings of a corresponding one of said pairs, said at least two tubular ducts being angularly mutually offset with respect to the axis of the cylindrical tubular element, at least a first one of said at least two tubular ducts corresponding to the intake of the air into the combustion chamber and at least a second one of said at least two tubular ducts corresponding to the exhaust of the burnt gases.

9. The internal combustion engine according to claim 8, further comprising engine cooling means which are adapted to circulate cooling fluid within said rotary distributor, so as to strike said at least two tubular ducts.

10. The internal combustion engine according to claim 1, wherein the outside diameter of said rotary distributor is substantially equal to a value of the diameter of said at least one cylinder plus the value of half of said diameter of said at least one cylinder, the area of said at least one port of said sealing element being substantially equal to one third of the value of the area of a circular contour of the cross-section of said protrusion.

11. The internal combustion engine according to claim 1, wherein said protrusion is provided laterally with at least one annular seat for corresponding sealing rings.

12. The internal combustion engine according to claim 1, wherein said engine block and said head are monolithic so as to provide a monobloc element.

13. A head of an internal combustion engine with rotary distribution, of the type to be fixed to the head of the engine block, comprising a cylindrical rotary distributor, an upper closure plate, and at least one sealing element, as set forth in claim 1, said head with said cylindrical rotary distributor, the upper closure plate and the at least one sealing element constituting a kit for replacing engine heads.

* * * * *